US007784875B2

(12) United States Patent
Holl et al.

(10) Patent No.: US 7,784,875 B2
(45) Date of Patent: Aug. 31, 2010

(54) CHISEL HOLDER SYSTEM

(75) Inventors: Bernd Holl, Neustadt/Wied (DE); Dieter Simons, Buchholz (DE)

(73) Assignee: Wirtgen GmbH, Windhagen (DE)

( * ) Notice: Subject to any disclaimer, the term of this patent is extended or adjusted under 35 U.S.C. 154(b) by 343 days.

(21) Appl. No.: 11/795,670

(22) PCT Filed: Dec. 7, 2005

(86) PCT No.: PCT/EP2005/013073

§ 371 (c)(1),
(2), (4) Date: Jul. 19, 2007

(87) PCT Pub. No.: WO2006/079389

PCT Pub. Date: Aug. 3, 2006

(65) Prior Publication Data

US 2009/0289493 A1 Nov. 26, 2009

(30) Foreign Application Priority Data

Jan. 26, 2005 (DE) ..... 10 2005 003 734

(51) Int. Cl.
*E21C 35/18* (2006.01)

(52) U.S. Cl. ..... 299/102; 299/108

(58) Field of Classification Search ..... 299/102, 299/108

See application file for complete search history.

(56) References Cited

U.S. PATENT DOCUMENTS

| | | | | |
|---|---|---|---|---|
| 3,992,061 | A * | 11/1976 | Rollins | 299/102 |
| 4,828,327 | A | 5/1989 | Wechner et al. | |
| 5,683,144 | A | 11/1997 | Kammerer et al. | |
| 6,866,343 | B2 | 3/2005 | Holl et al. | |

FOREIGN PATENT DOCUMENTS

| | | |
|---|---|---|
| DE | 43 22 401 A1 | 1/1995 |
| DE | 101 61 713 A1 | 7/2003 |
| DE | 20 2004 018 419 U1 | 2/2005 |

* cited by examiner

*Primary Examiner*—John Kreck
(74) *Attorney, Agent, or Firm*—Pauley Petersen & Erickson

(57) ABSTRACT

A chisel holder system including a base part and a chisel holder. The base part includes a socket wherein the chisel holder with a plug-in insert is introduced. The chisel holder has a bearing surface supported on a supporting surface of the base plate, and the base part has a shoulder connected to the supporting surface. A replacement chamber is formed between the shoulder and a facing end surface of the chisel holder. According to this invention, the supporting surface is placed in the transition region in relation to the shoulder by at least one recess of the shoulder so that the flat-shaped connection between the supporting surface and the shoulder, in the region of the recess, is interrupted in order to optimize the resistance to wear and tear of the base part.

11 Claims, 3 Drawing Sheets

CHISEL HOLDER SYSTEM

BACKGROUND OF THE INVENTION

1. Field of the Invention

This invention relates to a chisel holder system with a base element and a chisel holder, wherein the base element has a plug-in receptacle into which the chisel holder is inserted with a plug-in neck, the chisel holder is supported by a contact face on a support surface of the base element, the base element has a shoulder adjoining the support surface and a seating-adjustment space is formed between the shoulder and a facing end face of the chisel holder.

2. Discussion of Related Art

A chisel holder system is known from German Patent Reference DE 43 22 401 A1. This chisel holder system has a base element which can be welded, for example, to the shell face of a milling roller pipe of a road milling machine, and a plug-in receiver, into which a shaft-like plug-in neck of a chisel holder can be inserted. The base element has a shoulder around the plug-in receiver. The chisel holder is spaced apart from the shoulder for forming a seating-adjustment space. In this case, for transmitting the forces during the operation, the chisel holder is solely supported on the support surface of the base element. The chisel holder forms a wear element of the chisel holder system and must be exchanged when it reaches a wear limit.

In contrast, the base element must be protected as much as possible from the effects of wear, because it is the expensive part of the chisel holder system, which can only be replaced with a large mounting effort.

SUMMARY OF THE INVENTION

It is one object of this invention to provide a chisel holder system of the type mentioned but with a long service life.

This object is attained if in the transition area to the shoulder, the support surface is offset from the shoulder by at least one depression so that the flat connection between the support surface and the shoulder is interrupted in the area of or near the depression.

The support surface is delimited by the depression and a definite support area is created. If wear of portions of the chisel holder system should occur during their operation, the depression prevents the formation of a seam on the base element, because the chisel holder extends with a contact face past or beyond the support surface at the depression, and the contact face cannot there work itself into the support surface. Thus, the support surface maintains its shape and position. As soon as the chisel holder is worn out, it can be exchanged for a fresh one, which can again be definitely supported on the support surface.

In one embodiment of this invention, the depression is in the shape of a groove and forms an offset extending in a vertical direction with respect to the support surface.

The depression can be simply made. In the interior bottom the depression is preferably rounded, so that the notch tensions introduced into the base element are minimized.

If the contact face of the chisel holder projects past or beyond the support surface of the base element in the area of the depression and terminates there, the contact face of the chisel holder always projects past the support surface in the area of the depression. In this way a formation of a seam on the base element is dependably prevented in a simple manner.

In a further development of this step, the contact face of the chisel holder projects past the support surface of the base element on all sides. Thus, the contour of the contact face of the base element is shifted inward with respect to the contact face of the chisel holder. If wear should occur, the support surface will work itself into the support surface of the chisel holder and it itself remains unchanged. This embodiment also protects the support surface from removed material flowing off the chisel. In this way wash-outs on the support surface are prevented in a simple manner.

In one embodiment of this invention, the support surface of the base element is formed by a shoulder, whose cross-sectional dimensions extending parallel with the support surface are less than or equal to the contact face, at least in the area adjoining the support surface, so that on an outside the contact face projects past the shoulder in this area. In this way, the shoulder forms a wear area, inside of which the support surface can be worn off, but can always support the chisel holder to assure its correct function. It is thus possible to maintain the service life of the base element for a long time.

If the plug-in receptacle of the base element for the plug-in neck of the chisel holder extends as far as into the area of the support surface, then on its end facing the chisel holder the plug-in receptacle terminates in a cross-sectional widening, the depression terminates in the area of this cross-sectional widening and the chisel holder engages the cross-sectional widening with a transition section. The transition section guides the plug-in neck into the contact face. Thus the transition area between the depression and the cross-sectional widening is optimally matched to the dimensioning of the measurements of the contact face in the area of the plug-in neck.

Further optimization of the service life can be achieved if the chisel holder is of a lesser hardness in the area of or near the contact face, than the support surface of the base element.

BRIEF DESCRIPTION OF THE DRAWINGS

This invention is explained in view of an exemplary embodiment represented in the drawings, wherein:

FIG. 5 shows an assembled view of the components represented in

FIGS. 1 to 4; and

DETAILED DESCRIPTION OF THE INVENTION

Figure 2:
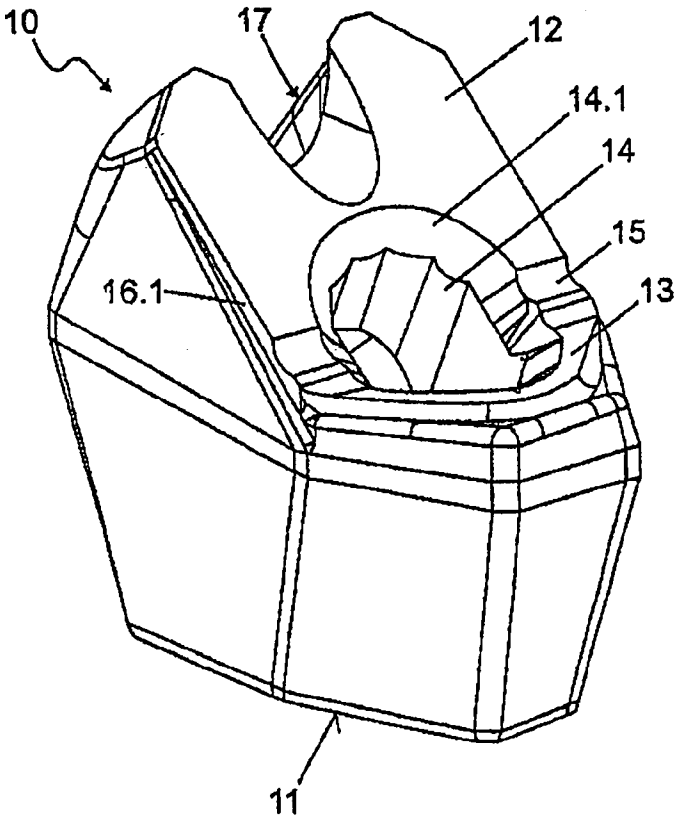
FIG. 2 shows the example according to FIG. 1, in a perspective front view.
Figure 1:
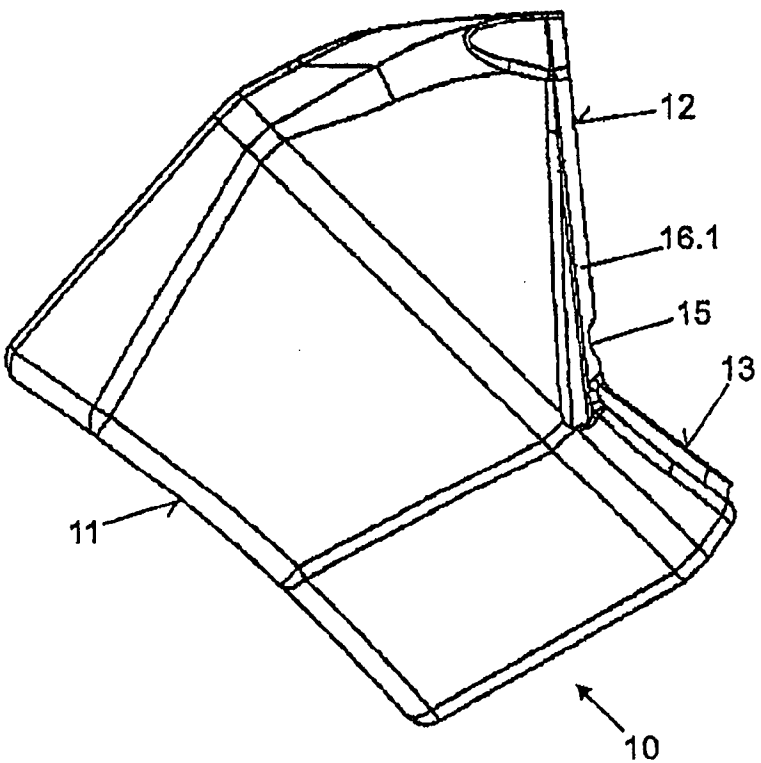
FIG. 1 shows a base element of the chisel holder system in a lateral view.

FIGS. 1 and 2 show a base element 10, which can be fastened by a curved connection face 11 to the exterior of a milling roller pipe of, for example a road milling machine. The base element 10 has a support surface 12, to which a shoulder 13 is connected at an angle. A plug-in receptacle 14 is cut in the form of a recess into the base element 10 in the transition area between the shoulder 13 and the support surface 10. The plug-in receptacle makes a transition by a cross-sectional widening 14.1 into the support surface 12, or into the shoulder 13.

The support surface 12 is supported by a shoulder 16.1. In this case, the shoulder 16.1 has the same cross-sectional dimension vertically in a direction with respect to the support surface 12 as the support surface 12. In the transition area between the support surface 12 and the shoulder 13, the support surface 12 is closed off by a depression 15. The depression 15 is arranged in the form of a groove on both sides of the plug-in receptacle 14 and creates a spatial connection between the cross-sectional widening 14.1 and the shoulder 16.1. In this case, the groove depth is selected so that, as a wear marking, it allows the wear of the support surface 12 to be detected.

Figure 4:
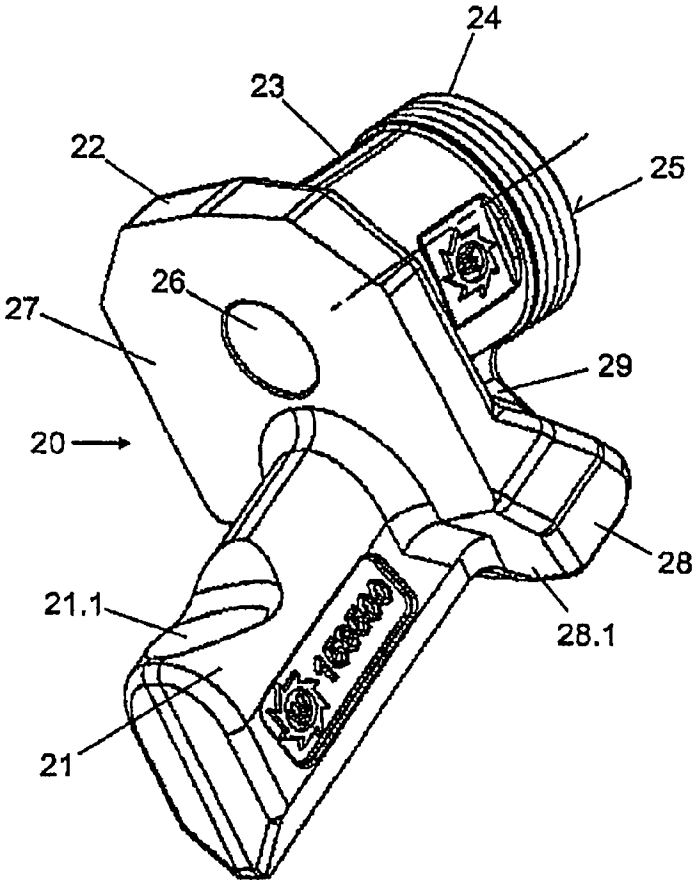
FIG. 4 shows the chisel holder according to FIG. 3 in a perspective plan view from the rear.
Figure 3:
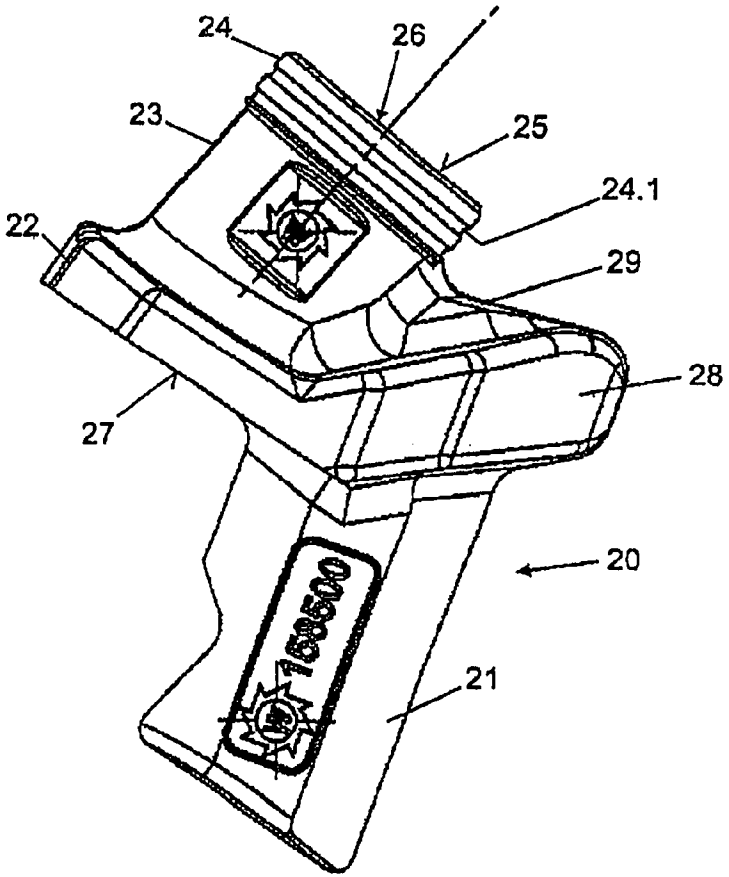
FIG. 3 shows a chisel holder of the chisel holder system in a lateral view.

FIGS. 3 and 4 show a chisel holder 20 having a base body 22. The base body 22 has a downward-directed contact face 27. An apron 28 adjoins the base body 22 at the front. A plug-in neck 21, whose cross section is matched to that of the plug-in receptacle 14 of the base element 10, protrudes in the transition area between the base body 22 and the apron 28.

As shown in FIG. 4, with a transition section 21.2 the plug-in neck 21 makes a transition into the contact face 27 of the base body 22 and into an end face 28.1 of the apron 28.

A neck 23, which has a cylindrical end section 24, is formed, facing away from the plug-in neck 21, on the base body 22. The end section 24 terminates in a ring-shaped support surface 25, into the center of which a chisel receptacle 26 is drilled.

To detect wear, the end section 24 has circumferential groove-like depressions 24.1. For stabilizing the neck 23, and for the improved flow-off of removed material, the neck 23 is connected with the apron 28 via a strip-like chip breaker 29.

As FIG. 4 shows, the plug-in neck 21 has a pressure plate 21.1.

Figure 6:
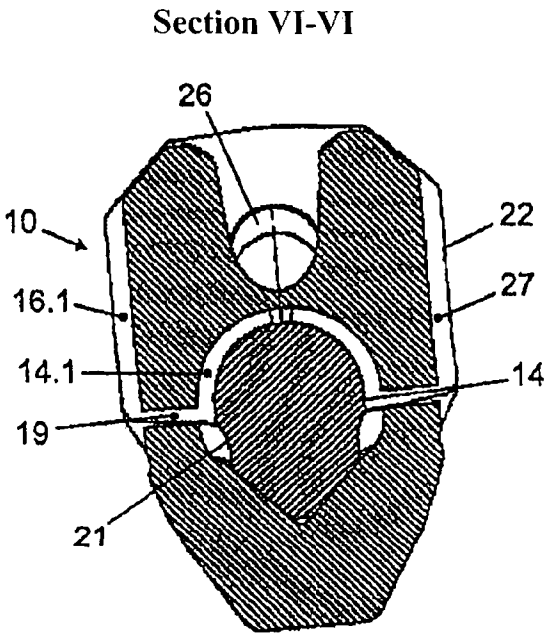
FIG. 6 shows a section view taken along the line identified by VI-VI in FIG. 5.
Figure 5:
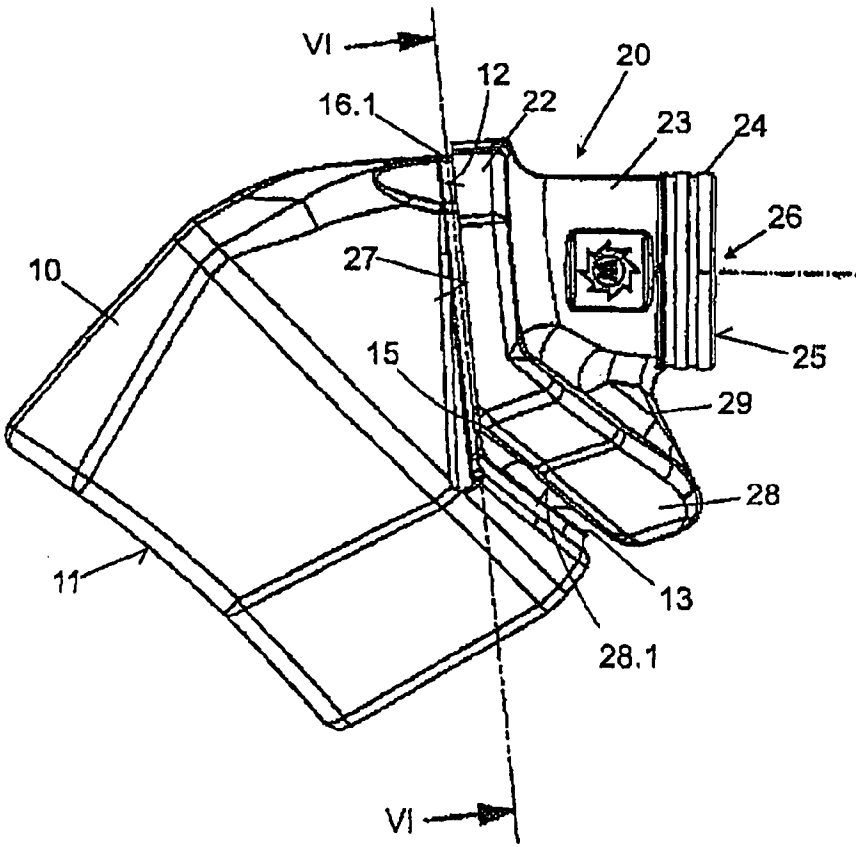

FIGS. 5 and 6 show the base element 10 and the chisel holder 20 in the assembled position. In this case, the plug-in neck 21 is inserted into the plug-in receptacle 14. The chisel holder 20 can be fixed in place on the base element 10 by a fastening screw, not represented in the drawings, which acts on the pressure plate 21.1 of the plug-in neck 21 and is screwed into the screw receptacle 17 of the base element 10. During this the contact face 27 is supported on the support surface 12. The end face 26.1 is spaced apart from the shoulder 13 for forming a seating-adjustment space.

As shown in FIG. 6, the contact face 27 of the chisel holder 20 protrudes all around past or beyond the support surface 12. In particular, the contact face 27 terminates in the area above the depression 15.

The invention claimed is:

1. A base element (10) for a chisel holder system wherein the base element (10) has a plug-in receptacle (14) into which the chisel holder (20) is insertable with a plug-in neck (21), the base element (10) has a support surface (12), the base element (10) has shoulder (13) adjoining the support surface (12) and a seating-adjustment space is formed above the shoulder (13), the base element (10) comprising:

in a transition area to the shoulder (13), the support surface (12) offset from the shoulder (13) by a depression (15) in a shape of a groove extending from each of opposite sides of the plug-in receptacle (14) which forms an offset extending in a vertical direction with respect to the support surface (12) so that the flat connection between the support surface (12) and the shoulder (13) is interrupted in the area of the depression (15).

2. A base element (10) for a chisel holder system wherein the base element (10) has a plug-in receptacle (14) into which the chisel holder (20) is insertable with a plug-in neck (21), the base element (10) has a support surface (12), the base element (10) has shoulder (13) adjoining the support surface (12) and a seating-adjustment space is formed above the shoulder (13), the base element (10) comprising:

in a transition area to the shoulder (13), the support surface (12) offset from the shoulder (13) by at least one depression (15) in a shape of a groove which forms an offset extending in a vertical direction with respect to the support surface (12) so that the flat connection between the support surface (12) and the shoulder (13) is interrupted in the area of the depression (15); and wherein a contact face (27) of the chisel holder (20) projects beyond the support surface (12) of the base element (10) and terminates near the depression (15).

3. The chisel holder system in accordance with claim 2, wherein the contact face (27) of the chisel holder (20) projects beyond the support surface (12) of the base element (10) on all sides.

4. The chisel holder system in accordance with claim 3, wherein the support surface (12) of the base element (10) is formed by a shoulder (16.1) having cross-sectional dimensions extending parallel with the support surface (12) that are less than or equal to the contact face (27) at least in an area adjoining the support surface (12), so that on an outside the contact face (27) projects beyond the shoulder (16.1) in the area.

5. The chisel holder system in accordance with claim 4, wherein on an end facing the chisel holder the plug-in receptacle (14) terminates in a cross-sectional widening (14.1), the depression (15) terminates near the cross-sectional widening (14.1), and the chisel holder (20) engages the cross-sectional widening (14.1) with a transition section (21.2), wherein the transition section (21.2) guides the plug-in neck (21) into the contact face (27).

6. The chisel holder system in accordance with claim 5, wherein the chisel holder (20) is of a lesser hardness near the contact face (27) than the support surface (12) of the base element (10).

7. The chisel holder system in accordance with claim 1, wherein a contact face (27) of the chisel holder (20) projects beyond the support surface (12) of the base element (10) on all sides.

8. A base element (10) for a chisel holder system wherein the base element (10) has a plug-in receptacle (14) into which the chisel holder (20) is insertable with a plug-in neck (21), the base element (10) has a support surface (12), the base element (10) has shoulder (13) adjoining the support surface (12) and a seating-adjustment space is formed above the shoulder (13), the base element (10) comprising:

in a transition area to the shoulder (13), the support surface (12) offset from the shoulder (13) by at least one depression (15) in a shape of a groove which forms an offset extending in a vertical direction with respect to the support surface (12) so that the flat connection between the support surface (12) and the shoulder (13) is interrupted in the area of the depression (15); and wherein the support surface (12) of the base element (10) is formed by a shoulder (16.1) having cross-sectional dimensions extending parallel with the support surface (12) that are less than or equal to a contact face (27) at least in an area adjoining the support surface (12), so that on an outside the contact face (27) projects beyond the shoulder (16.1) in the area.

9. A base element (10) for a chisel holder system wherein the base element (10) has a plug-in receptacle (14) into which the chisel holder (20) is insertable with a plug-in neck (21), the base element (10) has a support surface (12), the base element (10) has shoulder (13) adjoining the support surface (12) and a seating-adjustment space is formed above the shoulder (13), the base element (10) comprising:

in a transition area to the shoulder (13), the support surface (12) offset from the shoulder (13) by at least one depression (15) in a shape of a groove which forms an offset extending in a vertical direction with respect to the support surface (12) so that the flat connection between the support surface (12) and the shoulder (13) is interrupted in the area of the depression (15); and wherein on an end facing the chisel holder the plug-in receptacle (14) terminates in a cross-sectional widening (14.1), the depression (15) terminates at the cross-sectional widening (14.1), and the chisel holder (20) engages the cross-sectional widening (14.1) with a transition section (21.2), wherein the transition section (21.2) guides the plug-in neck (21) into a contact face (27).

10. The chisel holder system in accordance with claim 9, wherein the chisel holder (20) is of a lesser hardness near a contact face (27) than the support surface (12) of the base element (10).

11. The chisel holder system in accordance with claim 1, wherein the chisel holder (20) is of a lesser hardness near a contact face (27) than the support surface (12) of the base element (10).

* * * * *